United States Patent [19]

Choby, Jr.

[11] 4,010,050

[45] Mar. 1, 1977

[54] PROCESSING FOR ALUMINUM NITRIDE INHIBITED ORIENTED SILICON STEEL

[75] Inventor: Edward G. Choby, Jr., Pittsburgh, Pa.

[73] Assignee: Allegheny Ludlum Industries, Inc., Pittsburgh, Pa.

[22] Filed: Sept. 8, 1975

[21] Appl. No.: 611,060

[52] U.S. Cl. ..... 148/113; 148/27; 427/130

[51] Int. Cl.[2] ..... H01F 1/04

[58] Field of Search ..... 148/113, 112, 31.5, 148/27, 16.6, 111; 427/130

[56] References Cited

UNITED STATES PATENTS

| | | | |
|---|---|---|---|
| 1,965,798 | 7/1934 | Egan | 148/16.6 |
| 2,801,154 | 7/1957 | De Pree et al. | 148/27 |
| 3,399,085 | 8/1968 | Knechtel et al. | 148/16.6 |
| 3,676,227 | 7/1972 | Matsumoto et al. | 148/111 |
| 3,700,506 | 10/1972 | Tanaka et al. | 148/111 |
| 3,855,018 | 12/1974 | Salsgiver et al. | 148/112 |

*Primary Examiner*—Walter R. Satterfield
*Attorney, Agent, or Firm*—Vincent G. Gioia; Robert F. Dropkin

[57] ABSTRACT

A process for producing electromagnetic silicon steel having a cube-on-edge orientation and a permeability of at least 1850 ($G/O_e$) at 10 oersteds. The process includes the steps of: preparing an aluminum-bearing melt of silicon steel; casting the steel; hot rolling the steel; cold rolling the steel; decarburizing the steel; coating the steel with a base coating containing an amide and/or imide of an organic and/or inorganic acid; and final texture annealing the steel.

8 Claims, No Drawings

PROCESSING FOR ALUMINUM NITRIDE INHIBITED ORIENTED SILICON STEEL

The present invention relates to a process utilizing a base coating containing an amide or imide of an organic or inorganic acid, in the manufacture of electromagnetic silicon steel having a cube-on-edge orientation and a permeability of at least 1850 ($G/O_e$) at 10 oersteds; and to the base coating itself.

Laboratory experiments have indicated that some aluminum nitride inhibited oriented silicon steels develop good magnetic properties when final annealed in a nitrogen-bearing atmosphere, and unsatisfactory properties when similarly annealed in a hydrogen atmosphere. It is speculated that these steels are under-inhibited; and that during annealing in a nitrogen-bearing atmosphere, nitrogen enters the steel, thereby improving its inhibition characteristics and resultant magnetic properties.

While a nitrogen bearing atmosphere is beneficial in the laboratory, such is not always the case in the mill. Laboratory anneals do not simulate commerical anneals. In the mill, the steel is annealed as coils, and difficulty in diffusing nitrogen through the laps of the coils has been encountered.

The present invention provides for a more thorough distribution of nitrogen during annealing, and thereby overcomes the heretofore referred to difficulty encountered with nitrogen-bearing annealing atmospheres. More specifically, it provides for the use of a base coating containing a nitrogen-bearing substance. Significantly, the substance is from the group consisting of amides and imides of organic and inorganic acids.

Belgian Pat. No. 819,222 (published Dec. 16, 1974) and Japanese Pat. No. 6455/74 (published Feb. 14, 1974) describe processes in which aluminum nitride inhibited oriented silicon steel is final annealed with a nitrogen-bearing coating thereon. The Belgian patent discloses the use of metal nitrides in the coating, while the Japanese patent discloses the use of ammonium iodide. Neither the metal nitride nor the ammonium iodide is as desirable as the amides or imides of the present invention. The metal nitrides must be very finely divided or they will settle in the coating bath, and as a result require difficult and costly grinding. The ammonium iodide, on the other hand, decomposes and gives off nitrogen when subjected to high temperatures. As a result, its efficiency is sharply reduced. In fact, the process employing ammonium iodide only produced a permeability of 1800 ($G/O_e$) at 10 oersteds. The present invention specifies a minimum permeability of 1850 ($G/O_e$) at 10 oersteds.

It is accordingly an object of the present invention to provide a process utilizing a base coating containing an amide or imide of an organic or inorganic acid, in the manufacture of electromagnetic silicon steel having a cube-on-edge orientation and a permeability of at least 1850 ($G/O_e$) at 10 oersteds.

It is a further object of the present invention to provide a base coating containing an amide or imide of an organic or inorganic acid, for use in the manufacture of electromagnetic silicon steel having a cube-on-edge orientation and a permeability of at least 1850 ($G/O_e$) at 10 oersteds.

In accordance with the present invention, a melt of silicon steel is subjected to the conventional steps of casting, hot rolling, cold rolling at a reduction of at least 75%, decarburizing and final texture annealing; and to the improvement of adding an amide and/or an imide of an organic and/or inorganic acid to the base coating. Specific processing is not critical and can be in accordance with that specified in any number of publications including U.S. Pat. Nos. 3,855,018, 3,855,019, 3,855,020, and 3,855,021. The melt contains, by weight, up to 0.07% carbon, from 2.8 to 4.0% silicon, from 0.03 to 0.24% manganese, from 0.01 to 0.09% of material from the group consisting of sulfur and selenium, from 0.015 to 0.04% aluminum, up to 0.02% nitrogen, up to 0.05% copper and up to 0.0035% boron. As a general rule the balance of the melt is essentially iron. The invention does not, however, preclude the presence of other elements which improve magnetic properties and/or processing.

The base coating consists essentially of:

a. 100 parts, by weight, of at least one substance from the group consisting of boron, boron compounds, sulfur, sulfur compounds, selenium, selenium compounds, and oxides and hydroxides of magnesium, calcium, aluminum, titanium and manganese; and b. 4 to 120 parts, by weight, of at least one amide and/or imide of an organic and/or inorganic acid. The amides and/or imides are preferably present in an amount of from 10 to 40 parts, by weight. Although permeability appears to increase with increasing amounts thereof, some increase in core loss is also detectable. Typical examples thereof are sulfamic acid and urea. Sulfamic acid is the monoamide of sulfuric acid and urea is the diamide of carbonic acid.

The amides and imides of the present invention are believed to be particularly effective as they do not hydrolyze in the coating mixture. As a result nitrogen is not lost during application and drying of the coating. In fact, nitrogen is not released until final annealing is underway. The nitrogen of the amides and imides is covalently bound to the acidic moiety.

The following examples are illustrative of several aspects of the invention. As base coatings containing 100 parts, by weight, of oxides and hydroxides of magnesium are presently preferred, the following examples are directed to such coatings.

EXAMPLE I

A heat of steel was cast and processed into silicon steel having a cube-on-edge orientation. The chemistry of the heat appears hereinbelow in Table I.

TABLE I

| Composition (Wt. %) | | | | | | |
|---|---|---|---|---|---|---|
| C | Mn | Si | S | Al | N | Fe |
| 0.053 | 0.13 | 2.85 | 0.031 | 0.023 | 0.0055 | Bal. |

Processing involved soaking at an elevated temperature for several hours, hot rolling to a gage of approximately 93 mils, normalizing, cold rolling to a final gage of approximately 12 mils, decarburizing at a temperature of 1475° F in a mixture of wet hydrogen and nitrogen, applying one of three base coatings, an fianl texture annealing at a temperature of about 2150° F in one of two atmospheres. The three base coatings are as follows:

I. 100 parts MgO

II. 100 parts MgO + 5 parts $TiO_2$ + 1.5 parts $H_3BO_3$

III. 50 parts MgO + 50 parts sulfamic acid

The two atmospheres are as follows:

A. $H_2$

25% $N_2$ – 75% $H_2$, by volume.

The steel was tested for permeability and core loss. Results of the tests appear hereinbelow in Table II. Note that the results are arranged so as to reflect the base coating and atmosphere employed.

TABLE II

| Coating | Atmosphere | Permeability (at 10 $O_e$) | Core Loss (WPP at 17KB) |
|---|---|---|---|
| I. | A. | 1742 | 0.944 |
| I. | A. | 1828 | 0.790 |
| I. | A. | 1785 | 0.855 |
| II. | B. | 1872 | 0.757 |
| II. | B. | 1874 | 0.779 |
| II. | B. | 1862 | 0.790 |
| III. | A. | 1894 | 0.699 |
| III. | A. | 1891 | 0.705 |

From the results appearing in Table II, it is clear that the inclusion of sulfamic acid in the base coating improved texture development. Steel coated with coating III had a higher permeability and lower core loss than did steel coated with coatings I and II; despite the fact that the steel coated with coating II was final annealed; in the laboratory in a nitrogen-bearing atmosphere, whereas the steel coated with coating III ws not. Coating III was the only one of the three which contained an amide and/or imide of an organic and/or inorganic acid. Only the steel coated with coating III had a core loss below 0.725 watts per pound at 17KB.

EXAMPLE II

Another heat of steel was cast and processed into silicon steel having a cube-on-edge orientation. The chemistry of the heat appears hereinbelow in Table III.

TABLE III

| Composition (Wt. %) | | | | | | | | |
|---|---|---|---|---|---|---|---|---|
| C | Mn | Si | S | Al | N | Cu | B | Fe |
| 0.050 | 0.13 | 2.97 | 0.046 | 0.019 | 0.0064 | 0.24 | 0.0005 | Bal. |

Processing involved soaking at an elevated temperature for several hours, hot rolling to a gage of approximately 93 mils, normalizing, cold rolling to a final gage of approximately 12 mils, decarburizing at a temperature of 1475° F in a mixture of wet hydrogen and nitrogen, applying one of five base coatings, and final texture annealing at a temperature of about 2150° F in one of two atmospheres. The five base coatings are as follows:

I. 100 parts MgO

II. 100 parts MgO + 5 parts $TiO_2$ + 1.5 parts $H_3BO_3$

III. 90 parts MgO + 10 parts sulfamic acid

IV. 80 parts MgO + 20 parts sulfamic acid

V. 50 parts MgO + 50 parts sulfamic acid

The two atmosphere are as follows:

A. $H_2$

B. 25% $N_2$ – 75% $H_2$, by volume.

The steel was tested for permeability and core loss. Results of the test appear hereinbelow in Table IV. Note that the results are arranged so as to reflect the base coating and atmosphere employed.

TABLE IV

| Coating | Atmosphere | Permeability (at 10 $O_e$) | Core Loss (WPP at 17KB) |
|---|---|---|---|
| I. | A. | 1855 | 0.766 |
| I. | A. | 1863 | 0.742 |

TABLE IV-continued

| Coating | Atmosphere | Permeability (at 10 $O_e$) | Core Loss (WPP at 17KB) |
|---|---|---|---|
| II. | B. | 1875 | 0.762 |
| II. | B. | 1862 | 0.784 |
| III. | A. | 1898 | 0.692 |
| IV. | A. | 1883 | 0.708 |
| V. | A. | 1903 | 0.715 |

The results appearing in Table IV once again show the benefit of an amide and/or imide of an organic and/or inorganic acid in the base coating. Although the permeability of the steel is satisfactorily high regardless of the coating and atmosphere employed, only steel coated with a base coating containing sulfamic acid had a low core loss. Steel coated with coatings III, IV and V had a core loss below 0.725 watts per pound at 17KB. The core loss of the steel does, however, appear to reflect an increase with increasing amounts of sulfamic acid.

It will be apparent to those skilled in the art that the novel principles of the invention disclosed herein in connection with specific examples thereof will suggest various other modifications and applications of the same. It is accordingly desired that in construing the breadth of the appended claims they shall not be limited to the specific examples of the invention described herein.

I claim:

1. In a process for producing electromagnetic silicon steel having a cube-on-edge orientation and a permeability of at least 1850 ($G/O_e$) at 10 oersteds, which process includes the steps of: preparing a melt of silicon steel containing, by weight, up to 0.07% carbon, from 2.8 to 4.0% silicon, from 0.03 to 0.24% manganese, from 0.01 to 0.09% of material from the group consisting of sulfur and selenium, from 0.015 to 0.04% aluminum, up to 0.02% nitrogen, up to 0.5% copper and up to 0.0035% boron; casting said steel; hot rolling said steel; cold rolling said steel at a reduction of at least 75% decarburizing said steel; and final texturing said steel; the improvement comprising the steps of coating the surface of said steel with a base composition consisting essentially of:

a. 100 parts, by weight, of at least one substance from the group consisting of boron, boron compounds, sulfur, sulfur compounds, selenium, selenium compounds, and oxides and hydroxides of magnesium, calcium, aluminum, titanium and manganese; and b. 4 to 120 parts, by weight, of at least one substance from the group consisting of amides and imides of organic and inorganic acids;

and final texture annealing said steel with said coating thereon; said steel's texture and magnetic properties being, in part, attributable to said substance from the group consisting of amides and imides.

2. An improvement according to claim 1, wherein said composition has from 10 to 40 parts, by weight, of at least one substance from the group consisting of amides and imides of organic and inorganic acids.

3. An improvement according to claim 1, wherein said substance from the group consisting of amides and imides of organic and inorganic acids is from the group consisting of sulfamic acid and urea.

4. An improvement according to claim 3, wherein said composition contains sulfamic acid.

5. An improvement according to claim 1, wherein said composition has 100 parts, by weight, of oxides and hydroxides of magnesium.

6. An improvement according to claim 5, wherein said composition has from 10 to 40 parts, by weight, of at least one substance from the group consisting of amides and imides of organic and inorganic acids.

7. An improvement according to claim 5, wherein said substance from the group consisting of amides and imides of organic and inorganic acids is from the group consisting of sulfamic acid and urea.

8. An improvement according to claim 7, wherein said composition contains sulfamic acid.

* * * * *